US006978095B2

(12) United States Patent
Kato

(10) Patent No.: US 6,978,095 B2
(45) Date of Patent: Dec. 20, 2005

(54) MULTI-FUNCTION PROCESSING APPARATUS AND CONTROL PROGRAM FOR CHANGING DISPLAY ACCORDING TO FREQUENCY

(75) Inventor: Hiroyuki Kato, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/878,409

(22) Filed: Jun. 29, 2004

(65) Prior Publication Data

US 2004/0228645 A1 Nov. 18, 2004

Related U.S. Application Data

(63) Continuation of application No. 10/241,762, filed on Sep. 12, 2002, now Pat. No. 6,795,663.

(51) Int. Cl.[7] ..... G03G 15/00
(52) U.S. Cl. ..... 399/81; 358/1.15
(58) Field of Search ..... 399/1, 75, 77, 399/81, 82; 358/1.13, 1.15

(56) References Cited

U.S. PATENT DOCUMENTS 4,727,396 A * 2/1988 Matsuura ..... 399/197
5,982,995 A 11/1999 Covert et al.
6,246,487 B1 6/2001 Kobayashi et al.
6,292,267 B1 9/2001 Mori et al.
6,330,068 B1 12/2001 Matsuyama
6,341,907 B1 1/2002 Katsuyoshi
6,567,627 B2 * 5/2003 Maeda et al. ..... 399/81
6,621,992 B2 * 9/2003 Kishi et al. ..... 399/81
6,744,424 B2 * 6/2004 Maeda et al. ..... 345/173
6,795,663 B2 * 9/2004 Kato ..... 399/81

FOREIGN PATENT DOCUMENTS

JP 08335010 A * 12/1996 ..... G03G 21/00
JP 11-175225 A 7/1999
JP 2000-094787 4/2000
JP 2000-332929 11/2000
JP 2001042705 A * 2/2001 ..... G03G 21/00
JP 2001-101121 4/2001
JP 20011180089 A * 7/2001 ..... B41J 29/42

* cited by examiner

*Primary Examiner*—Robert Beatty
(74) *Attorney, Agent, or Firm*—Foley & Lardner LLP

(57) ABSTRACT

A multifunction copying apparatus, a control method of the apparatus, and a recording medium storing control software according to this invention can reduce the number of operations before the user reaches a necessary operation and improve the operability, by storing user's operation logs and changing the display contents and display settings on the basis of the stored information.

17 Claims, 10 Drawing Sheets

FILE(F) EDIT(E) VIEW(V) FAVORITE(A) TOOL(T) HELP(H)

BACK SEARCH FAVORITE LOG

ADDRESS(D) http://157.69.168.199/default.asp?hiddenTopMenu=Scan&hiddenSubMenu=Templates MOVE LINK >>

TopAccess g100d0c9059612:Ready I Online TopAccessComposer Device Search Login

Device | Print Jobs | Fax | Scan | Preferences | Counters

Templates

Template Groups

Please select a group to edit below.

Public Template Groups

| No. | | Group Name | Owner |
|---|---|---|---|
| Public | | Public Scan | |

Private Template Groups

All Groups | Defined Groups

Jump to : 001 011 021 031 041 051 061 071 081 091 101 111 121 131 141 151 161 171 181 191

| No. | | Group Name | Owner |
|---|---|---|---|
| 001 | | kato | Hiroyuki Kato |
| 002 | | Undefined | Undefined |
| 003 | | Undefined | Undefined |
| 004 | | Undefined | Undefined |
| 005 | | Undefined | Undefined |
| 006 | | Undefined | Undefined |
| 007 | | Undefined | Undefined |
| 008 | | Undefined | Undefined |
| 009 | | Undefined | Undefined |
| 010 | | Undefined | Undefined |

Go to top of this page

INTRANET

FIG.11

FILE(F) EDIT(E) VIEW(V) FAVORITE(A) TOOL(T) HELP(H)

BACK SEARCH FAVORITE LOG

ADDRESS(D) http://157.69.168.199/default.asp?hiddenTopMenu=Scan&hiddenSubMenu=Templates MOVE LINK >>

TopAccess g100d0c9059612:Ready | Online TopAccessComposer Device Search Login

Device | Print Jobs | Fax | Scan | Preferences | Counters

Templates

Private Templates ◂Template Groups

Group Information

| No. | Group Name | Owner |
|---|---|---|
| 001 | kato | Hiroyuki Kato |

Edit | Change Password | Reset Group

Panel View | List View

Please click a template picture to edit.

Jump to : 1-6 7-12 13-18 19-24 25-30 31-36 37-42 43-48 49-54 55-60

Templates 1-6

| | | | | | |
|---|---|---|---|---|---|
| 1 | | TWAIN | 2 | | File in |
| | | Scanner | | | Controller |
| 3 | | Send to | 4 | | Undefined |
| | | Email | | | Undefined |
| 5 | | PDF File | 6 | | Undefined |
| | | | | | Undefined |

Go to top of this page

INTRANET

FIG.12

FILE(F) EDIT(E) VIEW(V) FAVORITE(A) TOOL(T) HELP(H)

BACK SEARCH FAVORITE LOG

ADDRESS(D) http://157.69.168.199/default.asp?hiddenTopMenu=Scan&hiddenSubMenu=Templates MOVE LINK >>

TopAccess g100d0c9059612:Ready I Online TopAccessComposer Device Search Login

Device | Print Jobs | Fax | Scan | Preferences | Counters

Templates

Template Properties

Group Information

| No. | | Group Name | Owner |
|---|---|---|---|
| 001 | | kato | Hiroyuki Kato |

Template Information

| No. | | Template Name | Owner |
|---|---|---|---|
| 3 | | Send to_Email | |

Agent Settings

Send to Email [Select]

[Back] [Next]

*Required

| | |
|---|---|
| To | Number of Recipients:0<br>Go to Recipient List |
| Subject | ⊙ Scanned from (Device Name) [(Template Name)] (Date) (Time)<br>○ (Date) |
| *From | Hiroyuki1_Kato@toshibatec.co.jp |
| From Name | |
| Body | ⊙ No Message<br>○ The maximum size for body is about 1KB |
| File Format | Multi Page TIFF(G4) |
| Maximum Message Size | 20 MB |
| Fragment Message | ⊙ No Fragmentation<br>○ 64 KB<br>○ 256 KB<br>○ 512 KB |

INTRANET

FIG.13

| | GROUP NUMBER | TEMPLATE NUMBER | USE FREQUENCY |
|---|---|---|---|
| FUNCTION A | 1 | 10 | 1 |
| FUNCTION B | 2 | 50 | 6 |
| FUNCTION C | 3 | 30 | 3 |
| ... | | | |

MULTI-FUNCTION PROCESSING APPARATUS AND CONTROL PROGRAM FOR CHANGING DISPLAY ACCORDING TO FREQUENCY

The present application is a continuation of U.S. application Ser. No. 10/241,762, filed Sep. 12, 2002 U.S. Pat. No. 6,795,663, the entire contents of which are incorporated herein by reference.

BACKGROUND OF THE INVENTION

The present invention relates to a multifunction copying apparatus, a control method of the apparatus, and a recording medium storing a control program.

More specifically, the present invention relates to a multifunction copying apparatus, a method of controlling the multifunction copying apparatus, and a recording medium recording software for executing the control method. The present invention is particularly suited to controlling the display of a control panel of a multifunction copying apparatus and controlling the display of a Web window of a client personal computer.

PRIOR ART

Recently, a multifunction copying apparatus including functions as a digital copying machine and controller is widely used. This apparatus is in many cases used as it is connected across a network to a client personal computer, file server, and the like. The multifunction copying apparatus allows a user to operate the apparatus by a control panel of the apparatus or by a Web window of the personal computer across the network. The display contents of the control panel or Web window are controlled in accordance with preset parameters or parameters set by the user.

Japanese Patent Laid-Open No. 11-175225 discloses a technique by which menu operations customized for each user are changed in accordance with setting information recorded on an IC card owned by the user.

Also, to save the user the trouble of setting various conditions to activate a job, some multifunction copying apparatuses have a function called a job template (one-touch key). That is, various settings of a job are stored in one job template, so the job can be activated next time only by touching the job template once.

Various jobs are as follows.

(1) Copy Job

A copy job requires scan settings such as the number of copies and the scan mode, and finishing settings such as the presence/absence of staple/hole punch and double-sided/single-sided printing. These settings are stored in a mode memory.

(2) Scan Job

A scan job requires scan settings such as the scan mode, resolution, and rotation, and these settings are stored in a scan template. A file name and an agent which is the address of a transfer destination are also set in the scan template.

(3) FAX Transmission Job

A FAX transmission job requires scan settings such as the resolution, and these settings are set in a program key. The address of a transfer destination is also set in the program key.

For personal computers, on the other hand, Microsoft provides, by Microsoft Windows, Microsoft Office, Internet Explorer, and the like, an input compensating function using input logs and a function of non-displaying or folding unused functions.

Unfortunately, the conventional multifunction copying apparatus has the following problems.

(1) The number of functions of the multifunction copying apparatus is increased in recent years, and this complicates operations required to use necessary functions such as copying, scan, printing, and FAX. Also, since the number of functions is increased, the hierarchy of display/operation is deepened. Accordingly, operations before a user reaches a necessary function require much labor and time.

(2) Although the screen size of the display device of the multifunction copying apparatus is increased recently, the display capability is finite. The number of functions of the multifunction copying apparatus is increased, and these functions must be displayed in a hierarchical manner because they cannot be displayed in one window. If the number of hard keys is increased to avoid deepening the hierarchy, a user is confused.

(3) The contents displayed on the display device of the multifunction copying apparatus are fixed by the system and cannot be changed. For example, the display contents are preprogrammed, preset for each user, or set in a job template. Since the settings cannot be dynamically changed, a user is forced to set the display contents in advance. That is, the user must take time to set the display contents beforehand.

(4) There is a mismatch between the use frequencies at which a user uses the functions of the multifunction copying apparatus and the default display settings of the display device; the user sometimes takes much labor and time before he or she reaches a function to be used. Default settings of the display device are function settings as the greatest common divisor of users, i.e., are not suitable for individual users.

Recently, it is a common practice to provide each person with one personal computer. Therefore, once a user logs in to a computer, the display contents are customized as the display settings of that individual. As a consequence, each individual user does not feel inconvenience in UI operation so often as when using the operation unit of the multifunction copying apparatus.

The present invention has been made in consideration of the above situation, and has as its object to provide a multifunction copying apparatus, a control method of the apparatus, and a recording medium storing control software capable of reducing the number of operations before the user reaches a necessary function and improving the operability, by storing user's operation logs and changing the display contents and display settings on the basis of the stored information.

SUMMARY OF THE INVENTION

A multifunction copying apparatus of the present invention comprises a control panel which performs operations to realize various functions of the multifunction copying apparatus, an operation log storage unit which stores information concerning logs of operations performed on the control panel and/or information concerning logs of operations performed on a client personal computer, and a display controller which changes the display contents of the control panel and/or the display contents of the client personal computer, on the basis of the operation log information stored in the operation log storage unit.

The present invention is a method of controlling a multifunction copying apparatus, comprising the steps of storing information concerning logs of operations performed on a control panel of the multifunction copying apparatus and/or information concerning logs of operations performed on a client personal computer, and changing the display contents of the control panel and/or the display contents of the client personal computer, on the basis of the stored operation log information.

Also, the present invention is a recording medium storing software for controlling a multifunction copying apparatus, comprising the recording medium, and the software recorded in the recording medium and comprising a program code for storing information concerning logs of operations performed on a control panel of the multifunction copying apparatus and/or information concerning logs of operations performed on a client personal computer, and a program code for changing the display contents of the control panel and/or the display contents of the client personal computer, on the basis of the stored operation log information.

BRIEF DESCRIPTION OF THE DRAWINGS

FIG. 11 is a view for explaining an example of a client personal computer's Web window for setting a scan group in the embodiment;

FIG. 12 is a view for explaining an example of a client personal computer's Web window for setting a scan template in the embodiment;

FIG. 13 is a view for explaining an example of a client personal computer's Web window for setting agent parameters of the scan template in the embodiment;

DESCRIPTION OF THE PREFERRED EMBODIMENT

An embodiment of the present invention will be described below with reference to the accompanying drawings.

Functions realized by the embodiment to be described below are as follows.

(1) Operation logs of a multifunction copying apparatus are stored. On the basis of the stored information, control is so performed as to automatically change the display settings on the screen of a control panel of the multifunction copying apparatus and/or the display settings in a Web window of a client personal computer. This reduces the number of operations before the user of the multifunction copying apparatus reaches a necessary function.

(2) The display settings are dynamically changed on the basis of the stored operation logs. This saves the user the trouble of changing the display settings before a job is started.

(3) In connection with the formation of a job template, the apparatus is given a function of compensating for inputs on the basis of the operation log frequency. This facilitates the formation of a job template.

(4) In connection with the formation of a job template, the apparatus is given a function of correcting default parameters on the basis of the operation log frequency. This facilitates the formation of a job template.

Figure 1:
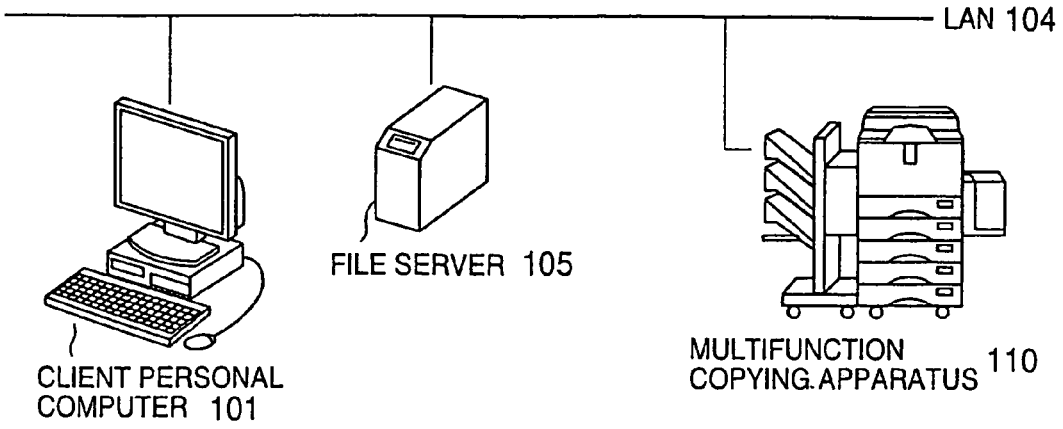
FIG. 1 is a block diagram showing the state in which a multifunction copying apparatus according to an embodiment of the present invention is connected across a network to a file server and client personal computer.

FIG. 1 shows the state in which a multifunction copying apparatus according to the embodiment of the present invention is connected across a network to a file server and client personal computer.

A file server 105, multifunction copying apparatus (MFP: Multi-Function Peripheral) 110, and client personal computer (PC) 101 are connected to a local area network (LAN) 104. The multifunction copying apparatus 110 has functions as a digital copying machine. The client personal computer 101 activates an application to output printing instructions to the multifunction copying apparatus 110 or set the multifunction copying apparatus 110.

Note that it is also possible to construct the multifunction copying apparatus 110 by using a controller and digital copying machine, and connect this digital copying machine to the local area network 104 via the controller.

Note also that the digital copying machine has a copying function of transferring the contents of an original onto a copying sheet. This copying function is the same as the conventional copying machine and realized by the same arrangement as the conventional copying machine, so a detailed explanation thereof will be omitted.

The controller has a network printing function. That is, the controller receives a printing command which is described in a page description language (PDL) and given from document formation software running on the client personal computer 101, forms image data from the PDL, and transfers the image data to the digital copying machine.

This controller further has functions of, e.g., transferring, trimming, and rotating image data, so that image data acquired by scan by the digital copying machine can be edited and processed on the client personal computer 101.

The controller also has an interface (I/F) such as network TWAIN.

Figure 2:
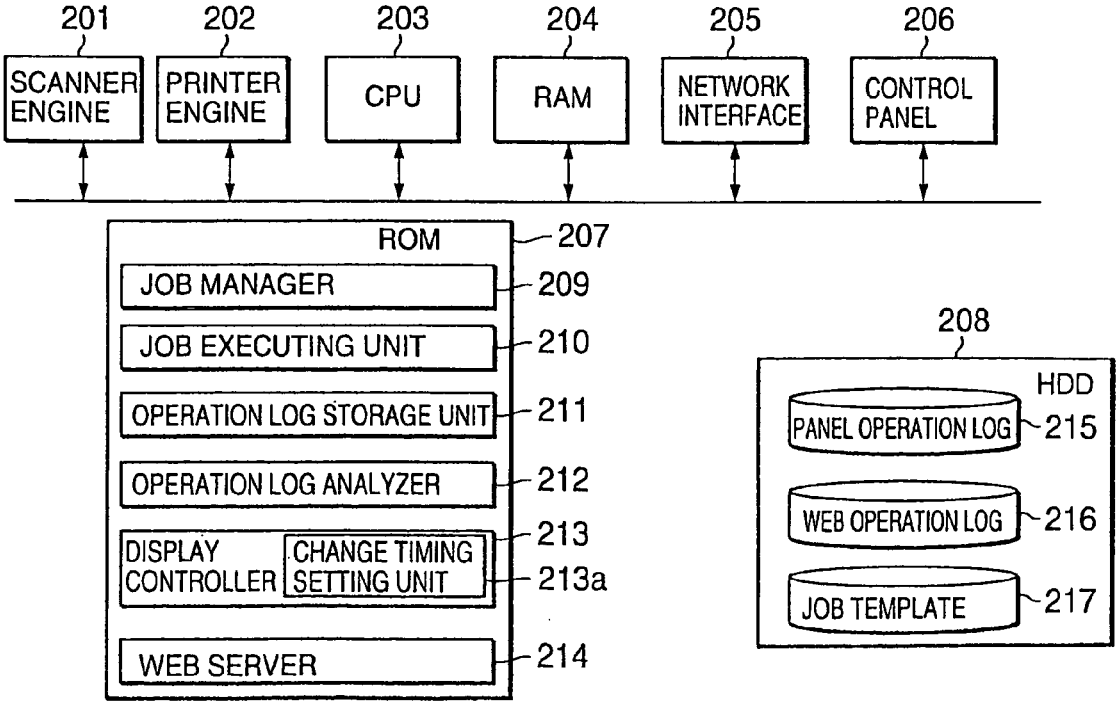
FIG. 2 is a block diagram showing the arrangement of a multifunction apparatus included in the embodiment.

FIG. 2 is a block diagram showing the arrangement of the multifunction copying apparatus according to the embodiment of the present invention.

This multifunction copying apparatus 110 includes a scanner engine 201, printer engine 202, CPU 203, random access memory (RAM) 204, network interface 205, control panel 206, read-only memory (ROM) 207, and hard disk drive (HDD) 208.

The scanner engine 201 is a module which performs scan. The printer engine 202 is a module which performs printing.

The CPU 203, RAM 204, ROM 207, and network interface 205 are hardware for controlling the system of this multifunction copying apparatus 101.

The control panel 206 is a module which provides a user interface by controlling a control panel.

The ROM 207 incorporates a job manager 209, job executing unit 210, operation log storage unit 211, operation log analyzer 212, display controller 213, and Web server 214. Databases stored in the HDD 208 are a panel operation log storage 215, Web operation log storage 216, and job template storage 217.

The job manager 209 is a module which stores information for controlling the operation of the job executing unit 210, and managing a copy job, scanner job, and print job.

The job executing unit 210 is a module which performs control necessary to execute each job.

The operation log storage unit 211 is a module which collects and saves operation logs.

The operation log analyzer 212 is a module which analyzes the operation logs saved in the operation log storage unit 211.

The display controller 213 is a module which stores control information of the image display on the control panel 206, and controls the Web window of the client personal computer 101. This display controller 213 includes a change timing setting unit 213*a* for setting a change timing, in order to allow the user to set the timing at which the display contents are changed.

The Web server 214 is an HTTP protocol server module.

The panel operation log storage 215 stores log information pertaining to operations on the control panel 206.

The Web operation log storage 216 stores log information concerning operations in the Web window of the client personal computer.

The job template storage 217 stores setting information of a job template.

Figure 3:
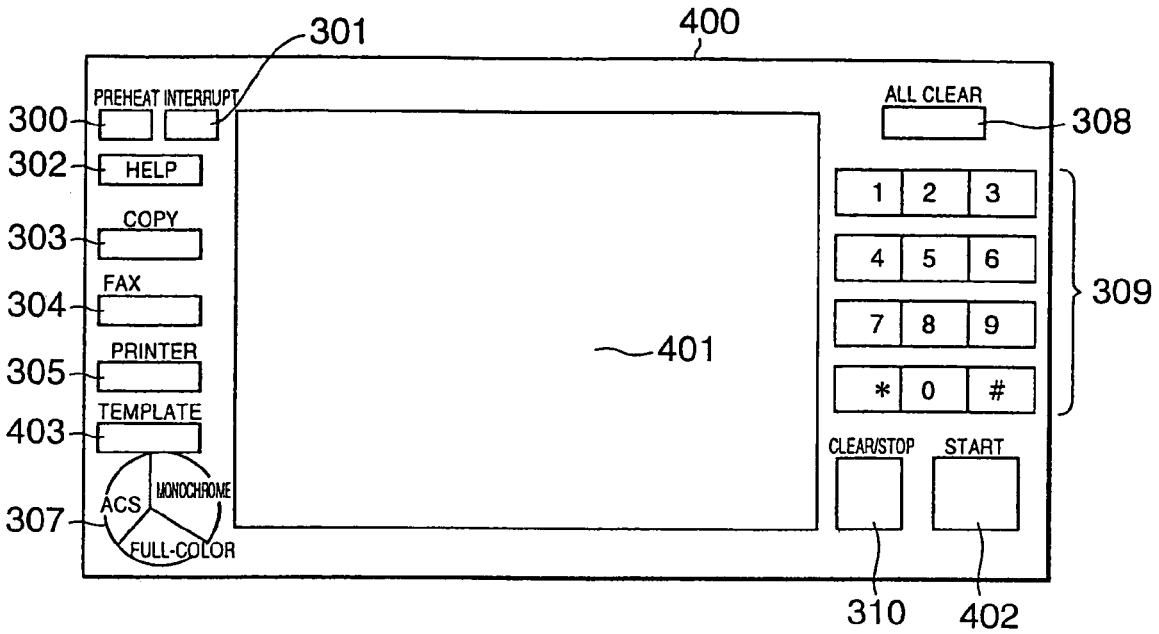
FIG. 3 is a view for explaining an example of the display of a control panel of a digital copying machine included in the embodiment.

FIG. 3 shows the contents of the image display on the control panel 206 of the multifunction copying apparatus 110. This multifunction copying apparatus 110 has functions as a color digital copying machine.

This control panel 206 includes a plurality of keys called hard keys on a display screen 400. These hard keys are a preheat key 300, interrupt key 301, help key 302, copy key 303, FAX key 304, printer key 305, mode switch key 307, all clear key 308, ten-key pad 309, clear/stop key 310, start key 402, and template key 403. The mode switch key 307 is used to perform switching between an ACS mode in which copying is performed by automatically selecting a color or monochrome mode in accordance with scan data, a monochrome mode in which copying is fixed to monochrome copying, and a full-color mode in which copying is fixed to full-color copying. The template key 403 is used to switch to a template UI. The control panel 206 also includes a touch panel 401 on the display screen 400.

Display control functions provided by this embodiment are mainly provided by operations to the touch panel 401 and start key 402.

FIGS. 4 to 8 illustrate several examples of the contents displayed on the touch panel 401.

Figure 4:
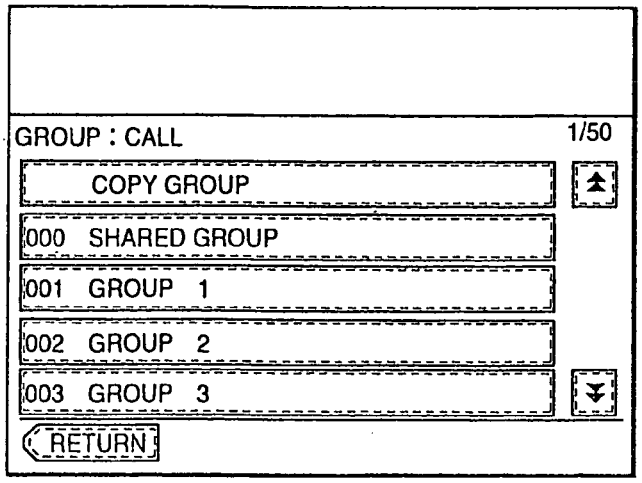
FIG. 4 is a view for explaining an example of a job template group window in the embodiment.

FIG. 4 shows an example of a job template group window display.

Job templates are formed for each group, and one group includes a plurality of job templates. These groups are numbered in order. About four to six groups are displayed in the initial window, since the display area of the touch panel 401 is limited. In this display example shown in FIG. 4, five groups are displayed in one window. 50 pages of windows are set as a whole.

To reach a desired group, the user must touch an icon indicating the group by scrolling the windows. When the desired group is selected, a window shown in FIG. 5 is displayed in accordance with the selected group.

Figure 5:
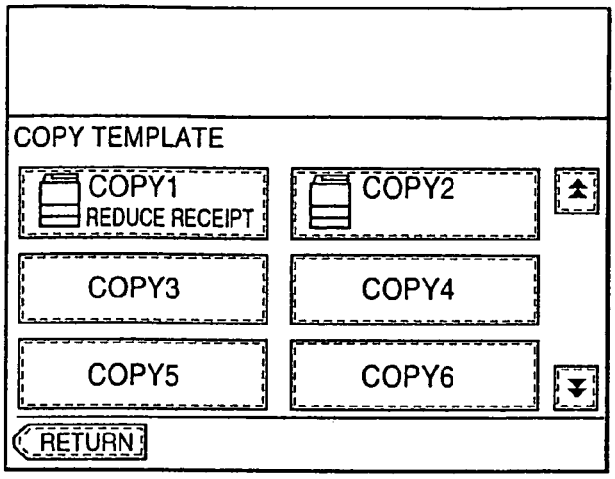
FIG. 5 is a view for explaining an example of a copy template window included in the embodiment.

In this example shown in FIG. 5, icons of six templates are displayed in one window because the display capability of the touch panel 401 is limited. These template icons are given numbers 1 to 6 in order and usually arranged in numerical order from the initial window. If the number of a template icon which the user wants to operate is large, the user must switch windows until the desired template icon is displayed, by touching a scroll icon several times. When any of the template icons is selected, a UI window related to the corresponding template is displayed in accordance with the selected template icon.

Figure 6:
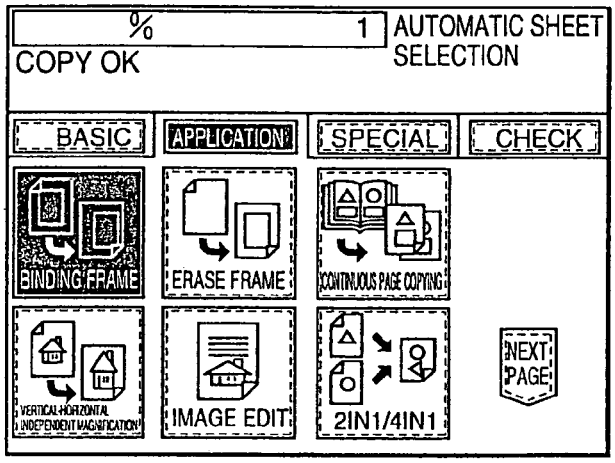
FIG. 6 is a view for explaining an example of a copy UI (User Interface) window included in the embodiment.

FIG. 6 shows an example of a copy UI window when a copy template as copy 3 shown in FIG. 5 is selected. In this copy UI window, icons are reversely displayed in accordance with items (scan settings and finishing settings) set by the template.

In this example, icons of functions "binding margin", "erase frame", "continuous page copying", "vertical-horizontal independent magnification", "image edit", "2IN1/4IN1 (two pages of originals are copied to one page/four pages of originals are copied to one page)" are displayed. As shown in FIG. 6, an icon of the "binding margin" function is reversely displayed. When the user places an original on the original table and presses the start key 402 in this state, a copy job based on this "binding margin" function is started.

Figure 7:
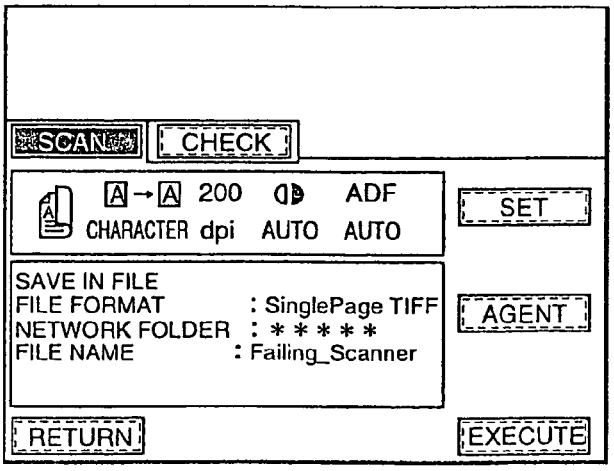
FIG. 7 is a view for explaining an example of a scan UI window in the embodiment.

If a scan template as copy 5 is selected in the window shown in FIG. 5, a scan UI window is displayed. FIG. 7 shows an example of this scan UI.

In the scan UI, an outline of the whole is displayed in accordance with items (scan settings and agent settings) set in the template.

If an "execute" icon in the window shown in FIG. 7 is touched or the start key 402 is pressed, a scan job is started. If a "set" icon in the window is touched, a scan parameter setting window is displayed to perform scan setting.

Figure 8:
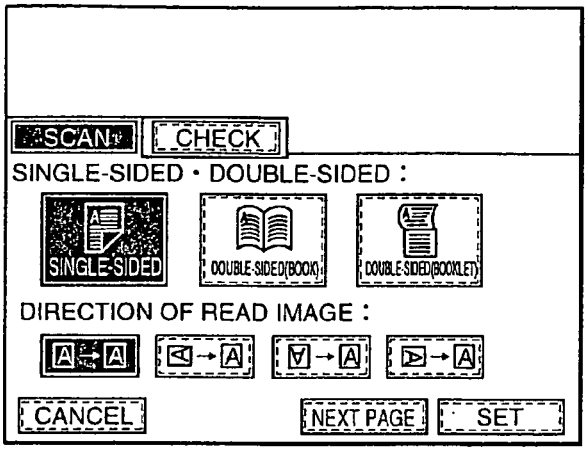
FIG. 8 is a view for explaining the first example of a scan parameter setting window in the embodiment.
Figure 9:
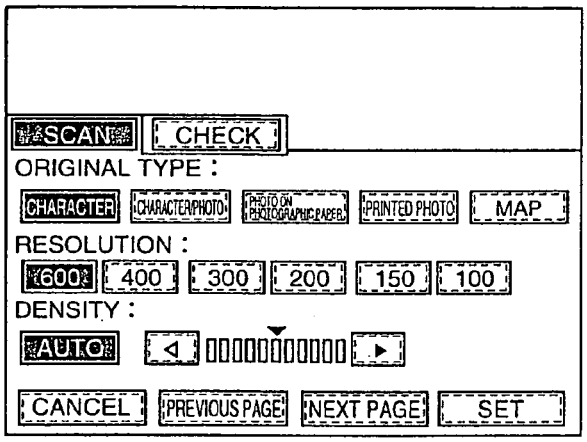
FIG. 9 is a view for explaining the second example of the scan parameter setting window in the embodiment.
Figure 10:
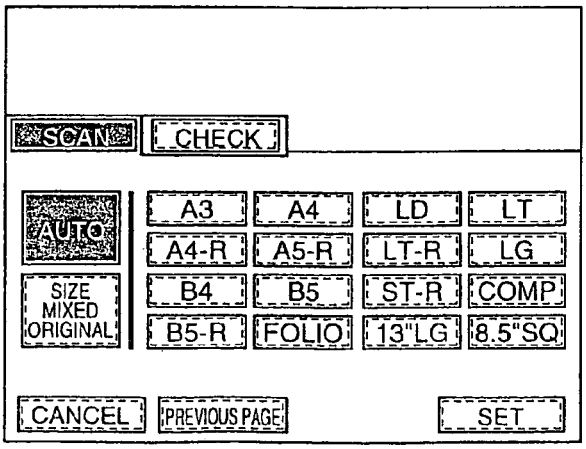
FIG. 10 is a view for explaining the third example of the scan parameter setting window in the embodiment.

FIGS. 8 to 10 illustrate examples of scan parameter setting windows. Scan parameters which the user can designate on the touch panel 401 are as follows.

(1) Double-Sided/Single-Sided (Single/Book/Tablet)

(2) Original Direction (Rotation)

(3) Original Type (Document Type)

(4) Resolution (5) Exposure Level (Exposure) or Density (6) Original Size

In the window shown in FIG. 8, parameters pertaining to (1) double-sided/single-sided and (2) original direction are displayed. Of these parameters, icons of (1) single-sided and (2) no rotation as selected parameters are reversely displayed.

In the window shown in FIG. 9, parameters concerning (3) original type, (4) resolution, and (5) exposure level or density are displayed. Of these parameters, icons of (3) text original, (4) resolution 600, and (5) density default setting as selected parameters are reversely displayed.

In the window shown in FIG. 10, parameters related to (6) original size are displayed. Of these parameters, an icon of (6) automatic selection as a selected parameter is reversely displayed.

FIGS. 11 to 13 illustrate examples of scan template setting windows.

FIG. 11 shows an example of a client personal computer's Web window for setting a scan group.

This Web window is displayed on a Web browser running on the client personal computer 101 when the Web server 214 uses a CGI to respond to an HTTP request from the client personal computer 101.

In this Web window, job templates are generated. In the Web window shown in FIG. 11, template groups are set. These template groups are assigned numbers "001", "002", . . . , "010" in order and displayed in numerical order in a default state. In this Web window, group "001" is placed in the uppermost position in the default state.

FIG. 12 shows an example of a client personal computer's Web window for setting scan templates. This Web window displays icons of six scan templates which correspond to the six copy templates shown in FIG. 5.

These scan templates are assigned numbers "1", "2", "3", . . . , "6" in order and displayed in numerical order in a default state. In this Web window, scan template 1 "TWAIN Scanner" is placed in the uppermost position in the default state.

FIG. 13 shows an example of a client personal computer's Web window for setting agent parameters of a scan template. This Web window shows a display example when a "Send to Email" agent in template "001" is selected.

In this scan template, a job by which image data acquired by scan is transferred as email is set. Destination "To", title "Subject", transmission source "From", transmitter name "From Name" text "Body", mail's attached file format "File Format", maximum message volume "Maximum Message Size", presence/absence and volume of fragment message "Fragment Message" are set as conditions.

The control method and control software of the multifunction copying apparatus according to this embodiment will be explained below.

Figure 14:
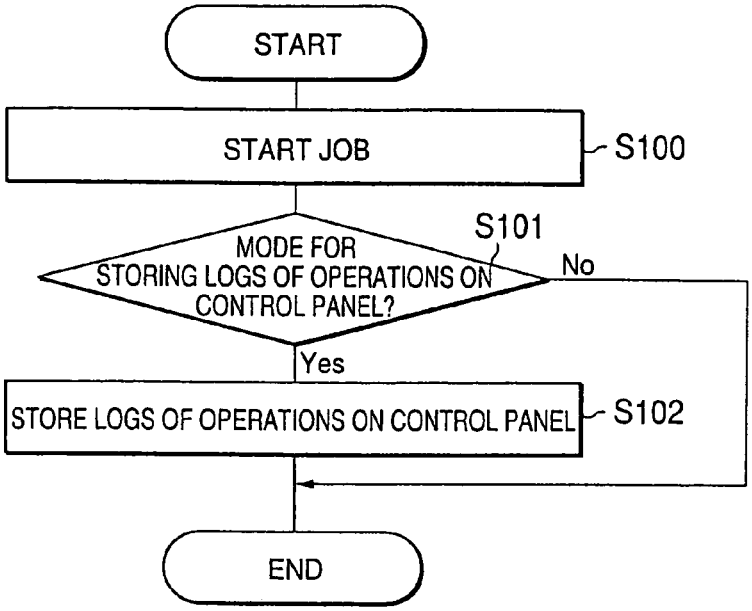
FIG. 14 is a flow chart showing the flow of the process of storing logs of operations on the control panel in the embodiment.

The flow of the process of storing logs of operations performed on the control panel 206 by the user in this embodiment will be described below with reference to FIG. 14.

In step S100, the job is started when the user presses the start key 402 or touches the "execute" icon displayed on the touch panel 401.

In step S101, whether the mode of storing logs of operations on the control panel is ON is checked.

If the mode of storing logs of operations on the control panel is ON, in step S102 the operation log storage unit 211 stores operation logs.

The logs of operations on the control panel are stored in the panel operation log storage 215. The stored information contains, e.g., the template parameters selected as job activation parameters, the group number of the user who has operated the control panel, and the selected template number.

If the mode of storing logs of operations on the control panel is OFF in step S101, the processing is terminated without performing the storage process.

Figure 15:
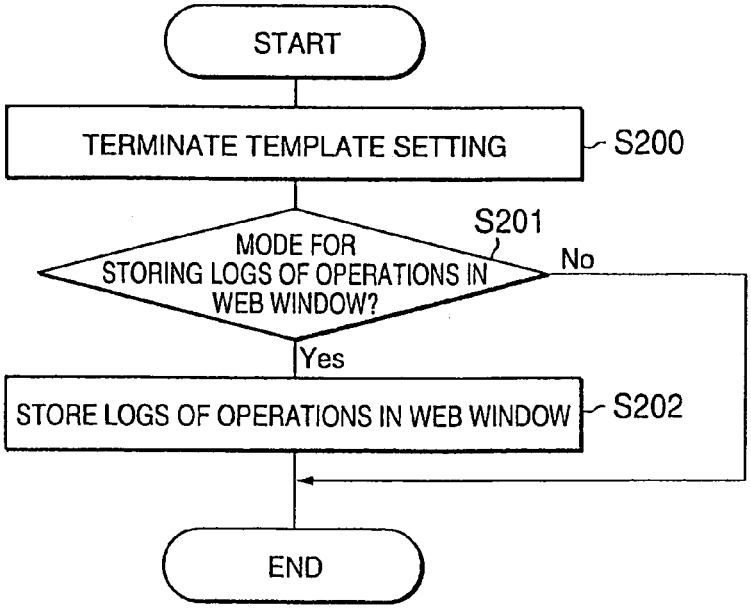
FIG. 15 is a flow chart showing the flow of the process of storing logs of operations in a client personal computer's Web window in the embodiment.

FIG. 15 shows the flow of the process of storing logs of operations in the Web window of the client personal computer in this embodiment.

If template setting is completed in the Web window in step S200, the flow advances to step S201.

In step S201, whether the mode of storing logs of operations in the Web window is ON is checked.

If the mode of storing logs of operations in the Web window is ON, in step S202 the operation log storage unit 211 stores operation logs. The logs of operations in the Web window are stored in the Web operation log storage 216. The storage information contains, e.g., the set template parameters, the group number of the user who has operated the Web window, and the selected template number.

If in step S201 the mode of storing logs of operations in the Web window is OFF, the processing is terminated without performing the storage process.

Figure 16A:
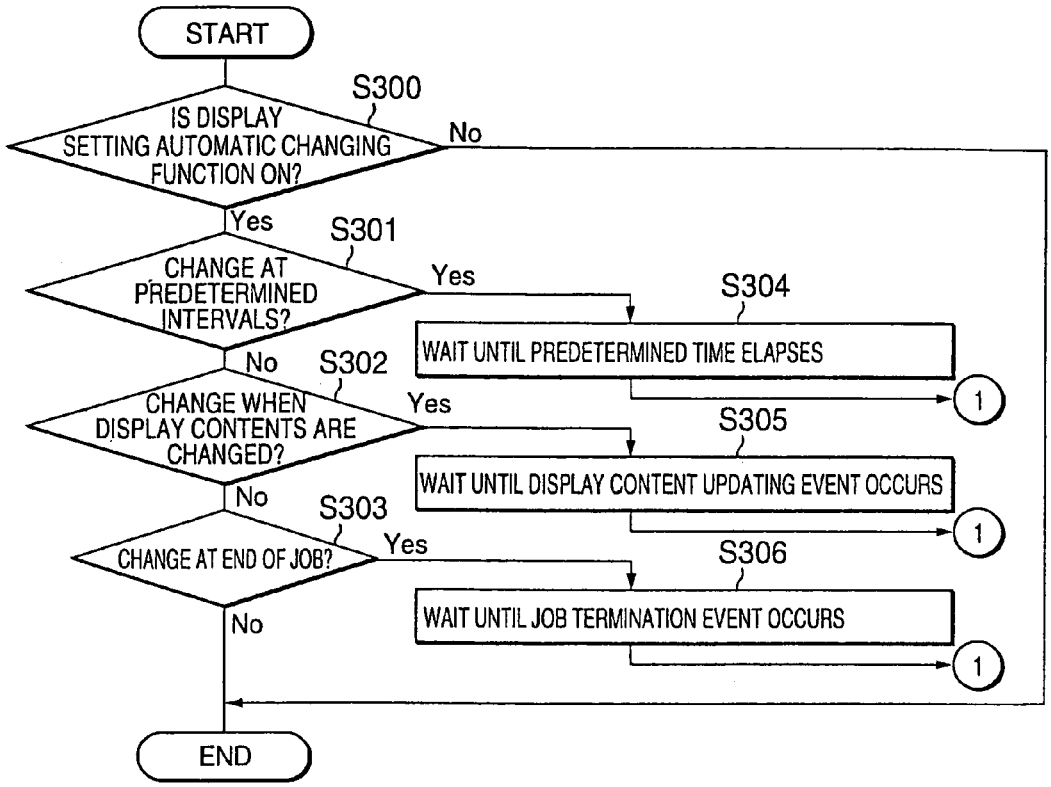
FIGS. 16A and 16B are flow charts showing the flow of the process of changing the display contents of the control panel and/or the client personal computer's Web window in the embodiment.

FIG. 16 shows the flow of the process of automatically changing the display settings in this embodiment.

When the operation log information storage function is ON, this display setting automatic changing function can be activated.

ON/OFF of the operation log information storage function can be set as system setting on the touch panel 401 or in the client personal computer's Web window. Similarly, ON/OFF of the display setting automatic changing function can be set as system setting on the touch panel 401 or in the Web window.

For example, the timings of this display setting automatic change are as follows.

(1) Predetermined time intervals.

(2) At the end of a job.

(3) When the display contents of the control panel and/or the Web window are updated.

In step S300, whether the display setting automatic changing function is ON is checked. If the display setting automatic changing function is OFF, the processing is terminated without performing the changing process. If the function is ON, the flow advances to step S301.

In step S301, whether the change is set to be performed at predetermined time intervals is checked. If the change is set to be performed at predetermined time intervals, the flow advances to step S304 to wait until a preset predetermined time elapses. After that, the flow advances to step S310 of the flow chart in FIG. 16B.

If in step S301 the change is not set to be performed at predetermined time intervals, the flow advances to step S302.

In step S302, whether the change is set to be performed when the display contents are changed is checked. If the change is set to be performed when the display contents are changed, the flow advances to step S305 to wait until an event for changing the display contents occurs. After that, the flow advances to step S310 of the flow chart in FIG. 16B.

If in step S302 the change is not set to be performed when the display contents are changed, the flow advances to step S303.

In step S303, whether the change is set to be performed at the end of a job is checked. If the change is set to be performed at the end of a job, the flow advances to step S306 to wait until an event for terminating a job occurs. After that, the flow advances to step S310 of the flow chart in FIG. 16B.

In step S303, if the change is not set to be performed at the end of a job, the processing is terminated without performing this changing process.

Figure 16B:
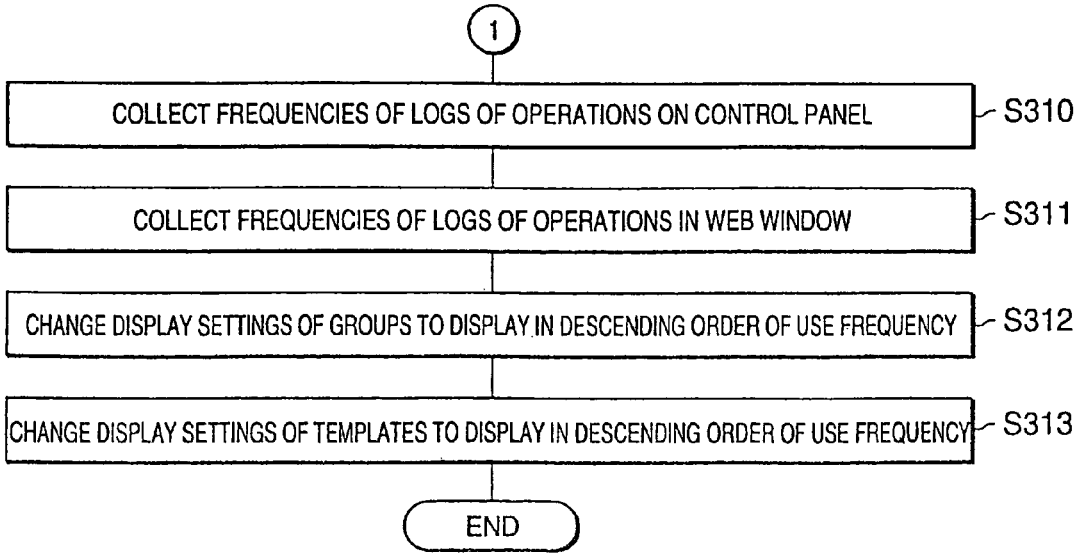

If the flow advances to the flowchart shown in FIG. 16B, in step S310 the frequencies of logs of operations on the control panel are totaled.

In step S311, the frequencies of logs of operations in the client personal computer's Web window are totaled.

In step S312, the display settings of the used template group are changed. More specifically, the groups are so rearranged as to be displayed in descending order of panel operation log frequency.

In step S313, the display settings of the used template are changed. More specifically, the display settings are so changed that a parameter having the highest operation log frequency is displayed in a default state, and this changing process is terminated.

Figures 17, 18:
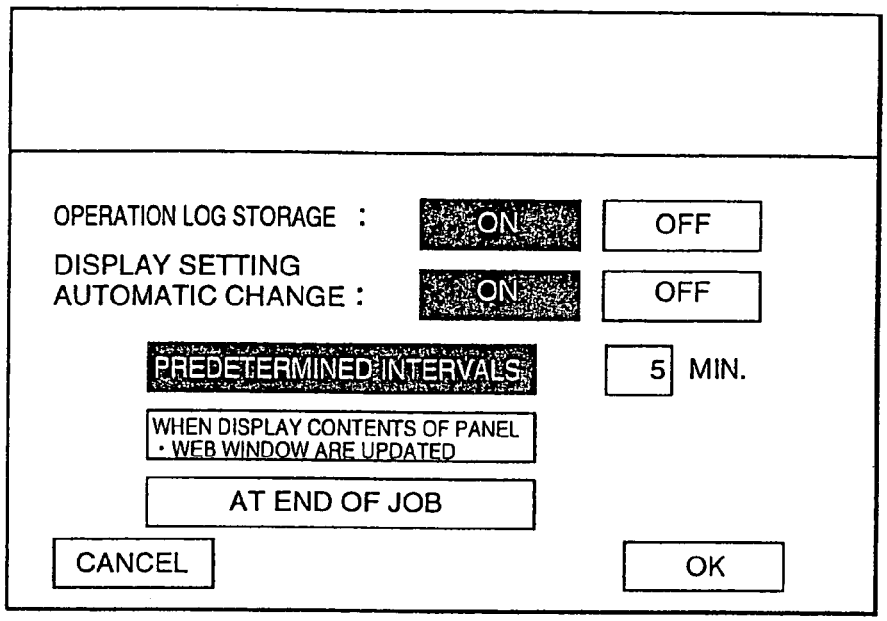
FIG. 17 is a view for explaining a setting window for automatically changing the display contents in the embodiment.
FIG. 18 is a view for explaining an example of the internal data structure of a panel operation log storage and Web operation log storage.

FIG. 17 shows an example of a window which the touch panel 401 displays to set the display setting automatic changing function.

This window includes icons for "storing (ON)"/"not storing (OFF)" operation logs.

If the icon for "storing (ON)" operation logs is selected and reversely displayed, the procedure advances to icons, arranged below the above-mentioned icons, for "changing (ON)"/"not changing (OFF)" display setting automatically.

If the icon for automatically "changing (ON)" the display setting is selected and reversely displayed, the procedure advances to an icon, placed below the above-described icons, for selecting a change timing.

As described previously, the three change timings are usable. One of these change timings can be selected and set in the change timing setting unit 213*a*.

(1) Predetermined intervals (2) At the end of a job (3) When the display contents of the panel and/or Web window are changed If "predetermined intervals" is selected, the interval time (e.g., 5 min) can be set.

FIG. 18 shows an example of the internal data structure of the panel operation log storage 215 and Web operation log storage 216.

Individual functions (function A, function B, function C, . . . ) each have a group number, template number, and use frequency as attributes. In this embodiment, function A has group number "1", template number "10", and use frequency "1" which is the highest use frequency.

The effects obtained by the above embodiment will be explained below.

(1) As shown in FIG. 4, the display settings can be changed such that a group icon having the highest use frequency is placed in the uppermost position of the initial window.

In this display example shown in FIG. 4, 50 pages of group windows are present (1/50 to 50/50), and "copy group" is placed at the head of page one (1/50). In this manner, the display settings can be changed by rearranging the positions of group icons.

(2) As shown in FIG. 5, the display settings can be changed such that a template icon having the highest use frequency is placed in the uppermost position of the initial window.

In this display example shown in FIG. 5, 10 pages of template windows are present (1/10 to 10/10), and a template "copy 1, reduce receipt" is placed at the head of page one. In this manner, the display settings can be changed by rearranging the positions of template icons.

(3) As shown in FIGS. 8 to 10, the display settings can be changed so that a parameter having the highest use frequency of the scan setting parameters is selected and reversely displayed in a default state.

(4) As shown in FIG. 11, the display settings can be changed so that a group icon having the highest use frequency is placed in the uppermost position of the page.

(5) As shown in FIG. 12, the display settings can be changed so that a template icon having the highest use frequency is placed in the uppermost position of the page.

(6) As shown in FIGS. 8 to 10 and 13, the display settings can be changed so that an agent parameter having the highest use frequency is selected and reversely displayed in a default state.

The display settings can be changed such that an operation frequently used by the user is displayed in a window closer to an initial window than other operations so as to reduce the number of operations by the user, and the display settings can be changed such that an operation not frequently used by the user is displayed in a window farther from the initial window than other operations so as to increase the number of operations by the user.

What is claimed is:

1. A multifunction processing apparatus comprising:

a control panel which performs operations to realize various functions of said multifunction processing apparatus;

an operation log storage unit which stores information concerning logs of a plurality of sequential operations performed on keys of said control panel; and a display controller which assigns the sequential operations stored in said operation log storage unit to each of job icons of said control panel, and changes the display contents of job templates indicated by the job icons of said control panel, on the basis of frequency of the operations performed on the keys of said control panel, using the information stored in said log storage unit, wherein said display controller changes the display contents such that operations frequently used by the user are displayed in a window closer to an initial window than other operations so as to reduce the number of operations by the user, and changes the display contents such that operations not frequently used by the user are displayed in a window farther from the initial window than other operations so as to increase the number of operations by the user.

2. An apparatus according to claim 1, wherein said display controller changes the display contents on the basis of the statistics of the use frequencies of the operation logs.

3. An apparatus according to claim 1, wherein said operation log storage unit stores information concerning logs of operations performed on a client personal computer, and said display controller changes the display contents of said client personal computer, on the basis of the operation log information stored in said operation log storage unit.

4. An apparatus according to claim 1, wherein said multifunction processing apparatus comprises copying function.

5. An apparatus according to claim 1, wherein said display controller changes the display contents such that the job icons frequently used by the user are displayed in a window closer to an initial window than other job icons.

6. An apparatus according to claim 2, wherein said control panel includes a timing selection display that enables a user to select a predetermined time interval by which the statistics of the use frequencies of the operation logs are recomputed.

7. A multifunction processing apparatus comprising:

a control panel for performing operations to realize various functions of said multifunction processing apparatus;

an operation log storage means for storing information concerning logs of a plurality of sequential operations performed on keys of said control panel; and a display control means for assigning the sequential operations stored in said operation log storage means to each of job icons of said control panel, and changing the display contents of job templates indicated by the job icons of said control panel, on the basis of the information stored in said operation log storage means, wherein said display control means changes the display contents such that operations frequently used by the user are displayed in a window closer to an initial window than other operations so as to reduce the number of operations by the user, and changes the display contents such that the operations not frequently used by the user are displayed in a window farther from the initial window than other operations so as to increase the number of operations by the user.

8. An apparatus according to claim 7, wherein said display control means changes the display contents on the basis of the statistics of the use frequencies of the operation logs.

9. An apparatus according to claim 7, wherein said operation log storage means stores information concerning logs of operations performed on a client personal computer, and said display control means changes the display contents of said client personal computer, on the basis of the operation log information stored in said means for storing information.

10. An apparatus according to claim 7, wherein said multifunction processing apparatus comprises copying function.

11. An apparatus according to claim 7, wherein said display control means changes the display contents such that the job icons frequently used by the user are displayed in a window closer to an initial window than other job icons.

12. An apparatus according to claim 8, wherein said control panel includes a timing selection display that enables a user to select a predetermined time interval by which the statistics of the use frequencies of the operation logs are recomputed.

13. Software product having a computer usable medium and a program stored on the medium for controlling a multifunction processing apparatus, said program comprising:

first program code for storing information concerning logs of a plurality of sequential operations performed on keys of a control panel for performing operations to realize various functions in an operation log storage unit of the multifunction processing apparatus; and second program code for assigning the sequential operations stored in said operation log storage unit to each of job icons of said control panel, and changing step for changing the display contents of job templates indicated by the job icons of the control panel, on the basis of the information stored in the operation log storage unit, wherein said second program code changes the display contents such that operations frequently used by the user are displayed in a window closer to an initial window than other operations so as to reduce the number of operations by the user, and changes the display contents such that the operations not frequently used by the user are displayed in a window farther from the initial window than other operations so as to increase the number of operations by the user.

14. A software product according to claim 13, wherein said second program code changes the display contents on the basis of the statistics of the use frequencies of the operation logs.

15. A software product according to claim 13, wherein said first program code stores information concerning logs of operations performed on a client personal computer, and said first program code changes the display contents of said client personal computer, on the basis of the operation log information stored in said operation log storage unit.

16. A software product according to claim 13, wherein the display contents are changed such that the job icons frequently used by the user are displayed in a window closer to an initial window than other job icons.

17. A software product according to claim 14, wherein said control panel includes a timing selection display that enables a user to select a predetermined time interval by which the statistics of the use frequencies of the operation logs are recomputed.

* * * * *